US007472710B2

(12) United States Patent
Jowett et al.

(10) Patent No.: US 7,472,710 B2
(45) Date of Patent: Jan. 6, 2009

(54) CONTAINER

(75) Inventors: Louise Jowett, Hull (GB); Judith Preuschen, Ludwigshafen (DE); Shaun Rymer, Hull (GB); Phil Shearsmith, Hull (GB); Ralf Wiedemann, Ludwigshafen (DE)

(73) Assignee: Reckitt Benckiser N.V., Hoofddorp (NL)

( * ) Notice: Subject to any disclaimer, the term of this patent is extended or adjusted under 35 U.S.C. 154(b) by 493 days.

(21) Appl. No.: 10/506,296

(22) PCT Filed: Mar. 5, 2003

(86) PCT No.: PCT/GB03/00921

§ 371 (c)(1),
(2), (4) Date: Mar. 2, 2005

(87) PCT Pub. No.: WO03/073907

PCT Pub. Date: Sep. 12, 2003

(65) Prior Publication Data

US 2005/0139241 A1 Jun. 30, 2005

(30) Foreign Application Priority Data

Mar. 6, 2002 (GB) ..... 0205249.6

(51) Int. Cl.
*B08B 13/00* (2006.01)

(52) U.S. Cl. ..... 134/93; 134/100.1; 68/17 R

(58) Field of Classification Search ..... 68/17 R, 68/207

See application file for complete search history.

(56) References Cited

U.S. PATENT DOCUMENTS

| | | | | |
|---|---|---|---|---|
| 3,062,030 | A | 9/1962 | Groves | 68/12 |
| 3,178,915 | A | 4/1965 | Hertel | 68/17 |
| 3,233,778 | A | 2/1966 | Cobb et al. | 221/232 |
| 3,482,733 | A | 12/1969 | Groves | 221/25 |
| 5,697,230 | A * | 12/1997 | Ender et al. | 68/3 SS |
| 6,177,398 | B1 | 1/2001 | McGregor et al. | 510/446 |
| 6,220,267 | B1 * | 4/2001 | Joshi | 137/9 |
| 6,352,158 | B1 * | 3/2002 | Cole-Bennett et al. | 206/532 |
| 6,581,800 | B2 * | 6/2003 | Rodd et al. | 222/54 |
| 2003/0227394 | A1 * | 12/2003 | Rothgeb et al. | 340/870.01 |

FOREIGN PATENT DOCUMENTS

| | | |
|---|---|---|
| DE | 43 44 205 A | 6/1995 |
| DE | 199 54 706 A | 5/2001 |

(Continued)

*Primary Examiner*—Frankie L Stinson
(74) *Attorney, Agent, or Firm*—Norris McLaughlin & Marcus, PA

(57) ABSTRACT

The present invention is directed to a device for receiving and holding a plurality of unit doses of a detergent composition and/or additive and for individually dispensing said unit doses into an automatic dishwashing machine over a plurality of washing cycles, wherein the device comprises (i) a housing adapted to receive said plurality of unit doses each separately contained in a package or compartment thereof, (ii) means for opening said package or compartment or for at least partly ejecting said unit dose therefrom; and (iii) means to allow access of water or wash liquor to said unit doses contained in the opened package or compartment or ejected therefrom within a controlled time period after opening thereof to allow dissolution of the unit dose into the water or wash liquor of the machine, as well as to a blister pack for use therewith.

12 Claims, 4 Drawing Sheets

FOREIGN PATENT DOCUMENTS

| | | | | |
|---|---|---|---|---|
| EP | 0 432 319 | | * | 12/1989 |
| EP | 1 104 805 | A | | 6/2001 |
| EP | 1 174 363 | A | | 1/2002 |
| GB | 838 637 | A | | 6/1960 |
| WO | WO 88/06199 | | | 8/1988 |
| WO | WO 97/09480 | | * | 3/1997 |
| WO | WO 01/07703 | | | 2/2001 |
| WO | WO 01/02557 | | * | 4/2001 |

* cited by examiner 1
2
3
4
5
10
11
13
14
20
21
24
27

CONTAINER

The present invention is related to a device for receiving and holding a plurality of unit doses of a detergent composition and/or additive and for individually dispensing said unit doses into an automatic dishwashing machine over a plurality of washing cycles as well as a blister pack for use with such a device.

In known automatic dishwashing machines, the detergent, whether in powder, tablet or gel form, is usually filled manually by the user into the machine, in particular into a detergent holder, before each dishwashing operation. Because of the necessity of handling the dishwashing detergent each and every time when a dishwashing cycle is to be started, this filling process is inconvenient, even with detergents in tablet form, when the problem of exact metering of the detergent and possible spillage thereof is avoided, which is an additional problem for powder and gel detergents. Moreover, even with careful handling, direct contact of the detergent with the user's skin is difficult to avoid in the usual filling process, which is again inconvenient because of the nature of usual detergent compositions.

From the prior art, a number of devices are known for holding unit doses of a detergent composition or additive, such as detergent tablets, and for dispensing of such unit doses into a machine.

For example, WO 88/06199 discloses a loader for holding and dispensing a washing additive including a receptacle in which there is a plurality of compartments each for receiving washing additive tablets. The compartments are at least partially defined by partitions forming part of a body, which is movable to bring each tablet adjacent to an opening provided in the receptacle. The tablets then pass through the opening to be dispensed, preferably under force of gravity.

Another device for dispensing of detergent tablets is described in DE 43 44 205 A1. The dosing device disclosed therein is mounted on the door of a dishwashing machine and loaded with a number of detergent tablets. The dosing device has an ejector for dispensing a single tablet each time the dishwashing machine is used. In a preferred embodiment, the dosing device has a reception shaft for receiving the detergent tablets one after the other, with the ejector being located at the bottom end of the shaft.

WO 01/07703 discloses a device for the metered release of a detergent composition or additive into a dishwashing machine having a number of separate closed chambers for holding the detergent composition or additive and means for opening the chambers, activated by conditions within the machine.

The object of the present invention is to provide for an improved device of above-defined type, i.e. for holding and individually dispensing unit doses of a detergent composition and/or additive into an automatic dishwashing machine, which allows a two-step release mechanism wherein, in the first step, a unit dose of a detergent composition and/or additive is transferred into a position from which it can, in a second step, be released into the machine with minimum energy required.

This object is achieved with a device of the kind referred to hereinabove, wherein the device comprises (i) a housing adapted to receive said plurality of unit doses each separately contained in a package or compartment thereof, (ii) means for opening said package or compartment or for at least partly ejecting said unit dose therefrom; and (iii) means to allow access of water or wash liquor to said unit doses contained in the opened package or compartment or ejected therefrom within a controlled time period after opening thereof to allow dissolution of the unit dose into the water or wash liquor of the machine.

Preferably, a holding pocket is provided for to receive and hold said unit dose, if ejected from the package or compartment, and means to controllably open and close the access of water or wash liquor to said holding pocket.

In an alternative embodiment the access of water or wash liquor to said unit dose, if contained in the opened package or compartment, is accomplished by a passageway between the interior of the machine and the opened package, said device having means to controllably open and close said passageway.

Preferably, the holding pocket or passageway is provided with a hinged or sliding door.

In one preferred embodiment of the invention, the access of water or wash liquor to said unit dose contained in the opened package or compartment or ejected therefrom is controlled by means reactive to a condition reached during the washing cycle of the machine, preferably by means reactive to the specific temperature of the wash liquor.

Alternatively, the access of water or wash liquor to said unit dose contained in the opened package or compartment or ejected therefrom is time controlled.

Said means for ejecting the unit dose from said package or compartment, in a preferred embodiment, comprises an ejector to act on at least one face of said package or compartment.

In an alternative embodiment, said means for opening said package or compartment comprises a piercing or cutting means to penetrate at least one of the package or compartment walls.

Preferably, said housing is adapted to receive a blister pack comprising said plurality of unit doses.

In a preferred embodiment, the device of the present invention is a portable device.

The invention is also related to a blister pack for use with a device according to the present invention.

Such blister pack is preferably in the form of a wheel-like plate with the unit doses arranged in at least one circle along the circumference thereof, or, alternatively, in the form of a row of unit doses arranged in a flexible loop.

The unit dose may be a detergent or detergent additive tablet or a detergent or detergent additive gel.

For the purpose of the present application, the term "unit dose" is used to mean the amount of detergent composition and/or additive required for one washing cycle of the automatic dishwashing machine. This amount can be provided for in any suitable form, such as powders, granules, gels, and liquids, optionally contained in pouches or formulated into tablets, and any mixtures thereof. For example, a unit dose might consist of a detergent powder composition and an additive in gel form contained in a pouch. For illustration purposes, but not restricted to this embodiment, the following more specific examples refer to a unit dose in the form of a tablet.

The device according to the present invention meets the objects as identified hereinabove in a surprisingly simple, effective and reliable way.

An important advantage of the device of the present invention is that it allows a two-step operation, namely, in a first step, opening the package or compartment containing a unit dose such as a tablet, or ejecting such unit dose from such package or compartment by means operated by the user immediately before the start of each washing cycle, and, in a second step, releasing the unit dose into the water or wash liquor of the machine at a controlled later stage, e.g. when a specific temperature in the machine is reached. By separating those two steps, it is possible to provide for a semi-automatic device for dispensing detergent unit doses into the machine in an easy and reliable way. It is not required to have any complicated automatic mechanism, for example, to be combined with the electronics or mechanics of the machine to open the package or eject the unit dose therefrom. Rather, the consumer is to operate the means of the device of the present invention for this part of the required operation. As substantial energy would usually be required for the first step, i.e. for opening the package or compartment or for ejecting the unit dose therefrom, it is possible to use the energy input from the consumer for such operation and to avoid providing for such energy input by the device itself. Thereby, the construction of the device can be made much simpler, and more reliable.

In a most preferred embodiment of the invention the device is a portable device, i.e. is adapted to be placed into a dishwashing machine at any suitable place, for example in the plate space of the lower rack of a dishwashing machine. It is not required to specifically mount or fix the device within the machine and/or to connect it to the electronics or mechanics thereof. The device is also preferably self-standing meaning that it does not require any specific connection with the machine to work properly.

The way of operation of the device of the present invention involves protection of the opened package or ejected unit dose from access of water or wash liquor until desired during the washing cycle. Therefore, it is necessary to provide for additional means for delay of such release, as proposed by the present invention.

In use, it has to be made sure that the detergent units in e.g. the blister pack are protected from access of water or wash liquor until the point in time when opening of the package or ejection of the tablet therefrom is desired. For accomplishing this, the package of the unit dose may be made of waterproof plastics material. Alternatively, the housing may be constructed in a waterproof manner to avoid any access of water or wash liquor thereinto for protection of the unit doses stored therein.

For easier understanding, the invention is now described in more detail by way of example, with reference to the accompanying drawings in which.

Figures 1, 2, 3:
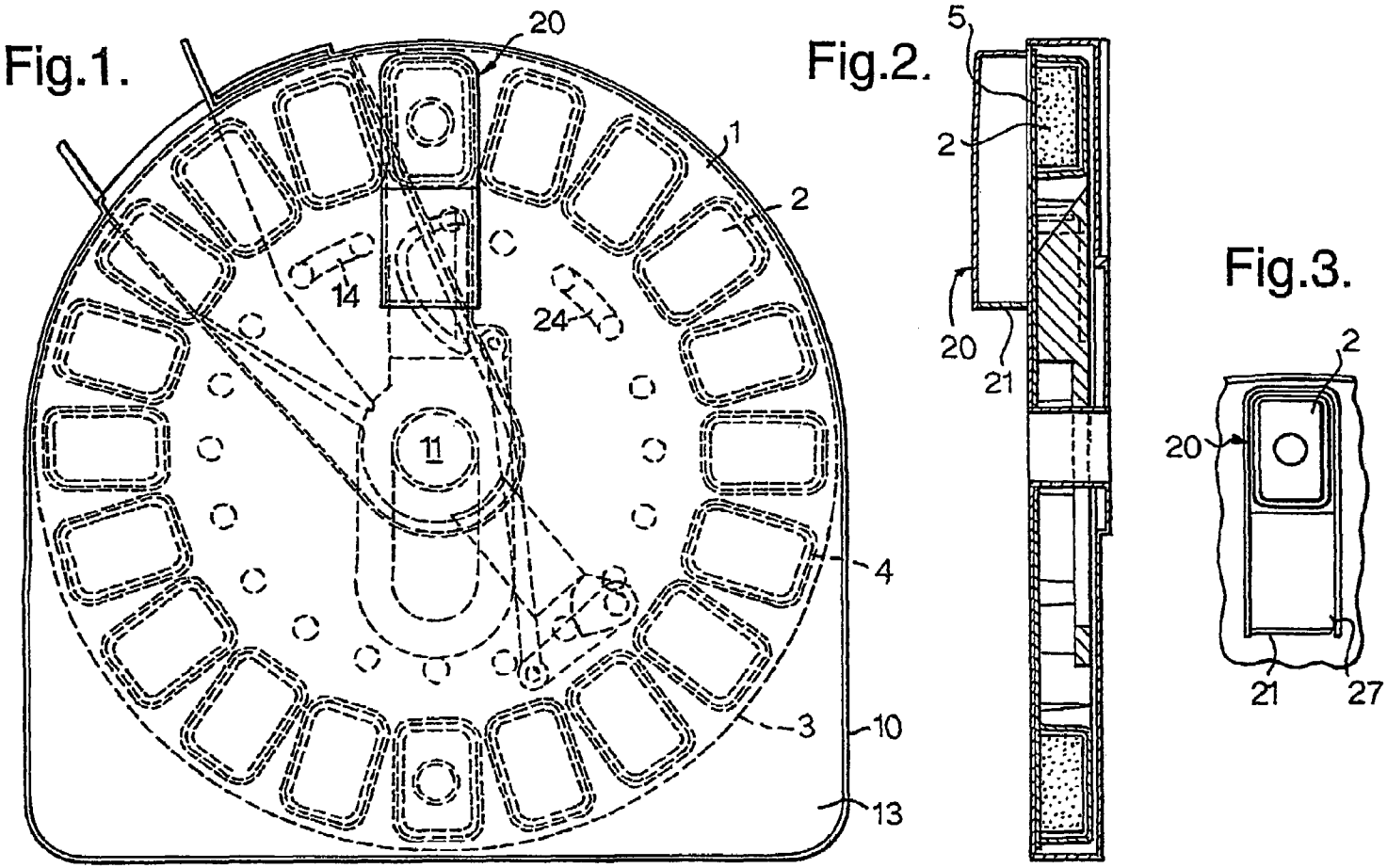
FIG. 1 is a plan view of one embodiment of the device according to the invention, loaded with a blister pack of detergent tablets.
FIG. 2 is a cross-sectional view along line A-A of FIG. 1.
FIG. 3 is a cross-sectional view along line B-B of FIG. 2.

Now first referring to the embodiment as illustrated in FIGS. 1 to 4, a blister pack 1 of a plurality of unit doses, namely tablets 2, is shown. This blister pack 1 is made of a circular wheel-like plate 3 of plastics material with deep-drawn compartments 4 along the circumference thereof to receive and hold the tablets. The plate 3 including the filled compartments 4 is covered by a foil 5 of plastics material. For ejection of the tablets from the compartments during operation of the device, weakening lines (not shown) or the like may be provided for around each single compartment 4.

An alternative embodiment of a blister pack (not shown) may be comprised of a row of individually packaged unit doses formed into a loop before or when loading into the device. In this case, the device of the present invention might have a different shape, i.e. not circular, but more elongate. The blister pack may e.g. have a form resembling a tank-track. Other forms and shapes of the blister pack and the device are within the scope of the present claims and may be considered as appropriate by someone skilled in the art.

Figure 4:
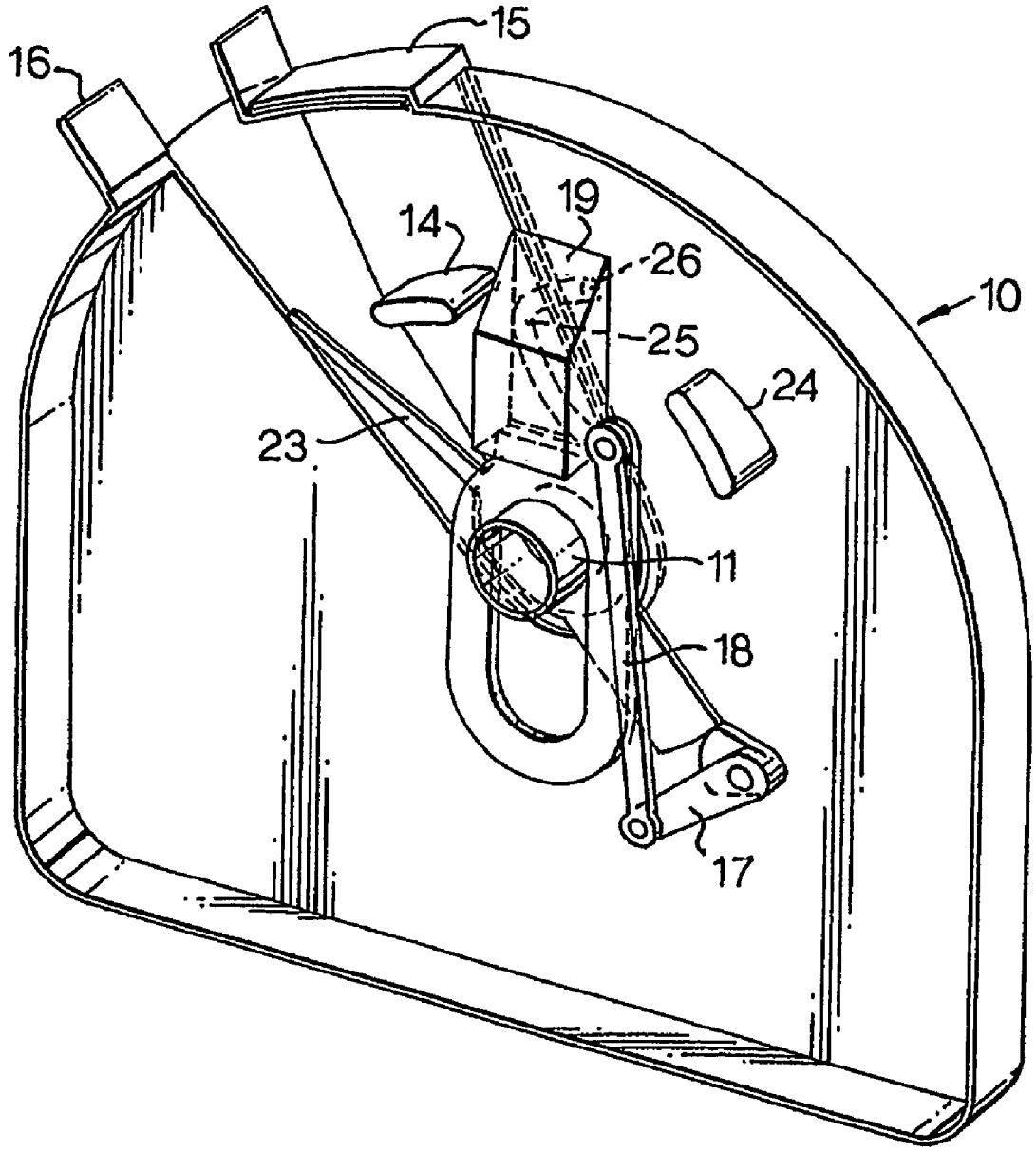
FIG. 4 is a perspective view of the device of FIG. 1 without the blister pack.

The blister pack 1 is loaded by the user into a device comprising a housing 10, which is shown, without the blister pack, in FIG. 4, and, in a state loaded with the blister pack located over the central hub 11 thereof in FIG. 1. The blister pack 1 is also partly located onto the blister-indexing pawl 14, which is part of the operating lever 15, the function of which is explained herein below. After loading the blister pack 1 into the device, a cover 13 is put in place to close the housing 10. In the drawings, the housing 10 is shown to be of transparent plastics material. The housing may, however, be made, in part or total, of opaque material.

For ejection of a tablet 2 from one of the compartments 4 of the blister pack 1, the operating lever 15 is pushed by the user against stop 16. Thereby, the operating lever 15 rotates a crank 17 through gear teeth (not shown) on the lower edge of the operating lever 15, which pushes, via a push rod 18, an ejector 19. The ejector 19 slides under the adjacent compartment 4 of the blister pack 1, ejecting a tablet 2 through the foil 5 covering the blister pack 1 and into a holding pocket 20 (see FIG. 2). By force of gravity, the tablet 2 then falls down onto trap door 21 closing holding pocket 20 at the lower end thereof.

On release of the operating lever 15 by the user, it returns by force of a spring member 23 to its original position. In the process, it indexes by way of the blister-indexing pawl 14 the blister pack 1 through a respective angle to bring the next tablet-containing compartment 4 into a dispensing position adjacent to ejector 19. The blister return stop 24 has a similar ramp to the pawl 14, which keeps the blister pack 1 rotating in a clock-wise direction.

Simultaneously, to the return of the operating lever 15, the ejector 19 is drawn back towards its original position. To avoid the ejector 19 to hit the adjacent compartment(s) 4 of the blister pack 1 during this procedure, a cam track 25 is included in the ejector 19 which guided by a pin 26 being part of the housing 10 allows it to move freely.

The device is now in a state activated by the user the tablet sitting on the trap door 21 of the holding pocket 20. To avoid access of water or wash liquor at this stage, the trap door 21 is, in the specific embodiment described, held shut by a bimetal catch 27. This bimetal catch bends when a specific temperature is reached in the dishwashing machine, e.g. around 35° C., to allow the trap door 21 to open and the tablet 2 to be released into the dishwashing machine. As a matter of course, opening of the holding pocket 20 may be accomplished in a different way, although a temperature triggered bimetal catch may be preferred as being easy and reliable. The opening of the trap door 21 may, of course, also be time controlled, e.g. open within a specific time period after activation of the device by the user.

It is, of course, not required that the tablet 2 is completely ejected from the pocket 4 in the blister pack 1 into the holding pocket 20. It can, for example, also be sufficient to destroy at least part of the walls of the package or compartment 4, including the covering foil 5, by a piercing mechanism operated, for example, in a similar way as the ejector of the present embodiment.

Then, during the operation of the dishwashing machine, a door or flap, for example again operated by a bimetal, may be opened to allow access of water or wash liquor into the device and to the contents of the compartment, then dissolving the tablet therefrom.

Figure 6:
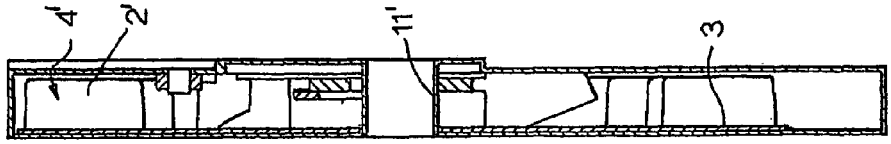
FIG. 6 is a cross-sectional view along line A-A of FIG. 5.
Figure 5:
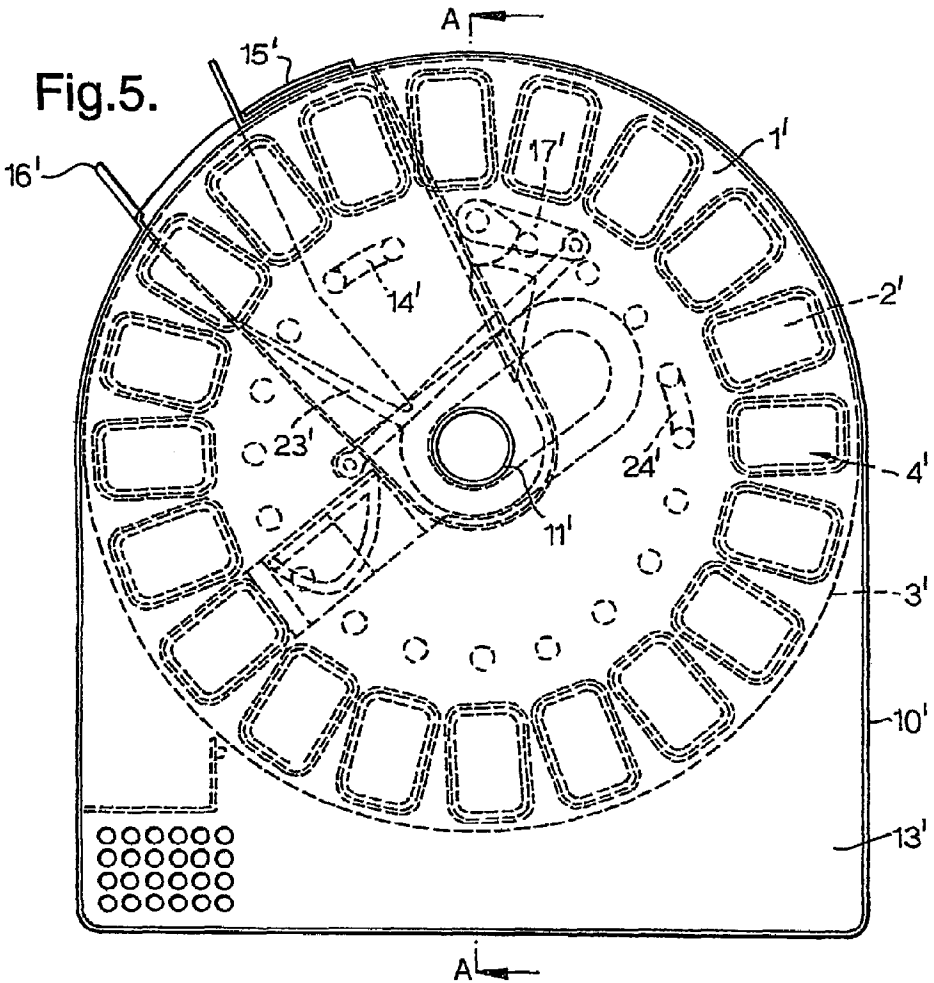
FIG. 5 is a plan view of another embodiment of the device according to the present invention, loaded with a blister pack of detergent tablets.
Figure 7:
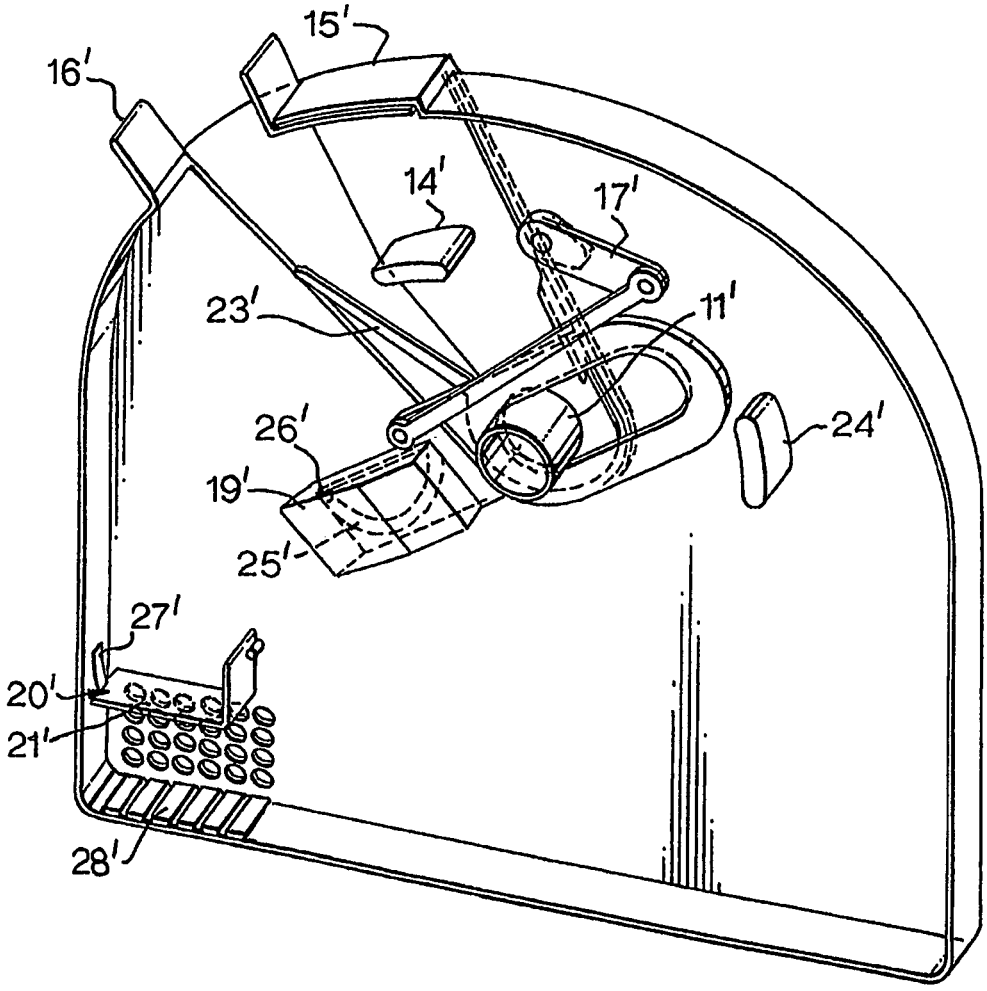
FIG. 7 is a perspective view of the device according to FIG. 5 without the blister pack.

The embodiment of FIGS. 5 to 7 is very similar in operation as the embodiment just described hereinabove. Similar components are designated by the same reference numerals with a stroke, such as 10' for the housing. In this case the ejector 19' has a different profile, designed to push a tablet 2' from the compartment 4' of a blister pack 1' radially outwards. The tablet then falls into a holding pocket 20' above sieve 28' in the housing 10' and is stopped from falling onto the sieve by a trap door 21', again latched by a bimetal catch 27' which will work in the same way as the trap door 21 in the embodiment of FIGS. 1 to 4, i.e. open upon rise of the temperature in the dishwashing machine to e.g. 35° C., to allow the tablet to fall onto the sieve 28' to then allow access of water or wash liquor dissolving the tablet.

The features disclosed in the foregoing description, in the claims and/or drawings may both separately and in any combination thereof be material for realizing the invention in diverse forms thereof.

The invention claimed is:

1. Device for receiving and holding a plurality of unit doses of a detergent composition and for individually dispensing the unit doses into an automatic dishwashing machine over a plurality of washing cycles, wherein the device comprises:

(i) a housing adapted to receive the plurality of unit doses, each separately contained in compartment of a plate, the unit doses being arranged along the circumference thereof;

(ii) means for opening a compartment or for ejecting a unit dose therefrom; and, (iii) means to allow access of wash liquor to the unit dose contained in the opened compartment or ejected therefrom, within a controlled time period to allow dissolution of the unit dose into wash liquor of the machine.

2. Device according to claim 1, wherein a holding pocket is provided to receive and hold the unit dose when ejected from the compartment and means to control the access of wash liquor to said holding pocket.

3. Device according to claim 2, wherein the holding pocket or passageway is provided with a hinged or sliding door.

4. Device according to claim 1 wherein the access of wash liquor to the unit dose when retained in the opened compartment is via a passageway , the device having means to controllably open and close the passageway.

5. Device according to claim 1, wherein the access of wash liquor to the unit dose retained in the opened compartment or ejected therefrom is controlled by means reactive to a condition reached during the washing cycle of the machine.

6. Device according to claim 5, wherein the access of wash liquor to the unit dose retained in the opened compartment or ejected therefrom is controlled by means reactive to the specific temperature of the wash liquor.

7. Device according to claim 1, wherein the access of wash liquor to the unit dose retained in the opened compartment or ejected therefrom is time controlled.

8. Device according to claim 1, wherein the means for ejecting the unit dose from the compartment comprises an ejector acting on a face of the compartment.

9. Device according to claim 1, wherein the means for opening the compartment comprises a piercing or cutting means to penetrate a wall of the compartment.

10. Device according to claim 1, being adapted to be a portable device.

11. Device according to claim 1 wherein the unit does is a detergent or detergent additive tablet.

12. Blister pack according to claim 1 wherein the unit dose is a detergent or detergent additive gel.

* * * * *